US006548453B1

(12) United States Patent
Narasimhan et al.

(10) Patent No.: US 6,548,453 B1
(45) Date of Patent: Apr. 15, 2003

(54) CONTINUOUSLY COATED MULTI-COMPOSITION, MULTI-LAYERED SOLID LUBRICANT COATINGS BASED ON POLYIMIDE POLYMER COMPOSITIONS

(75) Inventors: Dave Narasimhan, Flemingtonn, NJ (US); Robert Sedath, Bensenville, IL (US); Mathius P. Koljack, Schaumberg, IL (US); Wendy Nelson, Northridge, CA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/567,571

(22) Filed: May 4, 2000

(51) Int. Cl.[7] ..... C10M 125/00

(52) U.S. Cl. ..... 508/106; 508/106; 508/108; 428/327

(58) Field of Search ..... 508/108, 106

(56) References Cited

U.S. PATENT DOCUMENTS

| | | | | |
|---|---|---|---|---|
| 3,191,286 A | | 6/1965 | Armstrong et al. | 29/424 |
| 4,435,839 A | | 3/1984 | Gu et al. | |
| 4,500,678 A | | 2/1985 | Kita et al. | |
| 4,532,054 A | * | 7/1985 | Johnson | 508/106 |
| 4,610,918 A | | 9/1986 | Effenberger et al. | 428/245 |
| 4,831,977 A | | 5/1989 | Presswood | |
| 5,004,627 A | | 4/1991 | Presswood et al. | |
| 5,137,751 A | | 8/1992 | Burgess et al. | |
| 5,239,955 A | | 8/1993 | Rao et al. | |
| 5,246,782 A | | 9/1993 | Kennedy et al. | 428/421 |
| 5,257,603 A | | 11/1993 | Bauer et al. | |
| 5,363,821 A | | 11/1994 | Rao et al. | |
| 5,407,590 A | * | 4/1995 | Salvia | 508/106 |
| 5,427,698 A | * | 6/1995 | Hirokawa et al. | 508/106 |
| 5,482,637 A | * | 1/1996 | Rao et al. | 508/108 |
| 5,525,246 A | * | 6/1996 | Kamiya et al. | 508/108 |
| 5,560,283 A | | 10/1996 | Hannig | |
| 5,635,299 A | * | 6/1997 | Tanaka | 428/403 |
| 5,747,428 A | * | 5/1998 | Khorramian | 508/151 |
| 5,866,647 A | * | 2/1999 | Massey et al. | 524/494 |
| 5,958,847 A | | 9/1999 | Novak | |

FOREIGN PATENT DOCUMENTS

| | | |
|---|---|---|
| EP | 0 329 041 A2 | 8/1989 |
| GB | 975331 | 11/1964 |
| WO | WO 00/53702 | 9/2000 |

OTHER PUBLICATIONS

Cohen, E. and Gutoff, E., eds., *Modern Coating and Drying Technology*, Wiley–VCH Publishers, New York (1992).

Fusaro, R., *Polyimides: Synthesis, Characterization and Applications*, vol. 2, K. L. Mittal, Plenum Press, pp. 1053–80 (1984).

Fusaro, Robert L. and Sliney, Harold E., National Aeronautic and Space Administration Technical Note No. NASA TN D–6714, *Graphite Fluoride as a Solid Lubricant in a Polymide Binder*, Washington, D.C., Mar. 1972.

* cited by examiner

*Primary Examiner*—Ellen M. McAvoy
(74) *Attorney, Agent, or Firm*—William J. Zak, Jr., Esq.

(57) ABSTRACT

A lubricant coating disposed between a substrate and a counter surface comprises a reaction layer immediately adjacent the substrate. A bonding layer is immediately adjacent the reaction layer, with the bonding layer comprising a first composition. A low friction, lubricious layer is immediately adjacent the bonding layer, with the lubricious layer comprising a second composition that is different from the first composition.

37 Claims, 3 Drawing Sheets

CONTINUOUSLY COATED MULTI-COMPOSITION, MULTI-LAYERED SOLID LUBRICANT COATINGS BASED ON POLYIMIDE POLYMER COMPOSITIONS

BACKGROUND OF THE INVENTION

The present invention generally relates to lubricant coatings and, more particularly, to an apparatus and method for lubricating foils for fluid bearings in high speed rotating machinery.

Fluid bearings generally comprise two relatively movable elements (i.e., a bearing and a shaft also called a journal). A predetermined spacing between the bearing and shaft is filled with a fluid such as air. Foils (or thin sheets of a compliant material) disposed in the bearing are deflected by the hydrodynamic film forces between the adjacent bearing surfaces. The foils thus enhance the hydrodynamic characteristics of the fluid bearing and also provide improved operation under extreme load conditions when normal bearing failure might otherwise occur. Additionally, these foils provide the added advantage of accommodating eccentricity of the relatively movable elements and further provide a cushioning and dampening effect.

To properly position the foils between the movable bearing elements, it has been common to mount a plurality of individually spaced foils on a foil bearing disk and position the disk around the shaft. Another common practice has been to provide separate compliant stiffener elements or springs beneath the foils to supply the required compliance.

In the operation of fluid bearings, there can be actual rubbing contact between the foils and the bearing surfaces of the shaft. To minimize friction and wear, the foils are typically coated with a lubricant. Typical coatings which incorporate solid lubricants use several polymers and several solid lubricants. The compounds comprising the lubricant have included fluorinated hydrocarbon polymer, graphite, and molybdenum disulfide. In order to adhere the foregoing compounds to a metal substrate, a binder has typically been added to the lubricant composition. For example, graphite fluoride with a polyimide resin binder has been used.

Yet, a polyimide composition that is suitable to bond to a substrate may not likely be suitable to act as a lubricant. Further, polyimide compositions with solid lubricants contain solvents. Such compositions cannot be applied as a thick layer due to the formation of bubbles and imperfections (e.g., segregation of solids into lumps) during a curing cycle. Otherwise, performance of the layer is compromised. Therefore, in U.S. Pat. No. 4,435,839, a multi-layered coating of a graphite-fluoride-polyimide mixture was applied to a roughened contact surface. After the application of each sub-coat, the contact surface and sub-coatings were cured. Also, the outer coating surface was de-roughened at predetermined thickness intervals during the application of the multiple sub-coatings to provide the needed surface smoothness and thickness uniformity. The final overall coating was cured and then a graphite fluoride powder was burnished into the final sub-coat. Yet, the multiple steps required in this process make the actual practice of the invention costly and time consuming.

Similar to U.S. Pat. No. 4,435,839, the 1972 National Aeronautics and Space Administration Technical Note no. NASA TN D-6714 entitled "Graphite Fluoride as a Solid Lubricant in a Polyimide Binder" discloses a method of roughening the contact surfaces and alternating the application of a thin coat of a mixture of polyimide and solid lubricant with baking the thin coat. After the desired multi-layered coating thickness was achieved, the coating was further cured. Again, the need for alternating thin layers and curing results in high manufacturing costs.

In addition to the problems of merely adhering a lubricant coating to a substrate, there are performance problems of the coating itself. In one example of addressing coating performance, a lubricant using a partially defluorinated graphite fluoride with a resin such as polyimide was provided in U.S. Pat. No. 4,500,678. The graphite fluoride was dispersed in a dispersion medium and then the mixture was subjected to electromagnetic radiation. The radiation effects partial degradation of the graphite fluoride such that the fluorine atoms were partially removed. The partial degradation was said to allow greater compatibility with resins, greases, and oils that may be mixed with the degraded graphite fluoride to produce the final lubricant. Disadvantages, however, to this invention include loss of fluorine, loss of lubricating properties, increased wetting, and degradation of coatings due to oil contamination.

In another instance of addressing performance, R. Fusaro, in "Polyimides: Synthesis, Characterization and Applications", Vol. 2, edited by K. L. Mittal, Plenum Press, pp. 1053–80 (1984) describes the use of polyimide with either molybdenum disulfide and graphite fluoride. Fusaro suggested that ambient temperature and atmosphere affect the friction and film wear properties of the polyimide films. In particular, some polyimides possessed a transition temperature, above which the molecules obtained a degree of freedom in movement. Dry air appeared to lower the transition temperature, according to Fusaro. Thus, Fusaro sought to alter the polyimide by the addition of graphite fluoride, for example, to induce the shear formation of thin layers at temperatures below the transition to obtain optimum lubrication.

The problems of coating performance and bonding the coating to a substrate are illustrated in FIG. 1. Therein, graphite fluoride in a polyimide resin matrix was applied over a stainless steel substrate. The graphite fluoride quickly reacted with the stainless steel surface to form oxides and fluorides in a layer that is thick and porous. This problem of a brown layer forming under the coating is enhanced by the water produced by the polyimide during a high temperature cure. The resulting coating peels off or is easily scratched off. An Energy Dispersive X-ray Analysis (EDAX) chemical analysis of the brown layer in FIG. 1 shows the presence of Cr, Fe, O, and F, indicating the formation of fluorides and oxides of Fe and Cr (FIG. 2).

Additional related disclosures are found in U.S. Pat. Nos. 5,958,847; 5,560,283; 5,363,821; 5,257,603; 5,239,955; 5,137,751; 5,004,627; and 4,831,977.

As can be seen, there is a need for an improved lubricant coating for fluid bearings, as an example. Another need is for an improved method of making a lubricant coating. Also needed is a lubricant coating and method of making the same that provides improved bonding to a substrate. A lubricant coating and method of making the same is needed that provides better friction and wear properties at the same time, forming a better bond. A lubricant coating is needed that obviates the need for multiple thin layers and alternating curing steps, which otherwise leads to increased manufacturing time and costs. Further needed is a lubricant coating that provides chemical reactivity with the substrate on which the coating is applied to produce good bond quality between the coating and substrate.

SUMMARY OF THE INVENTION

In one aspect of the present invention, a lubricant coating disposed between a substrate and a counter surface comprises a reaction layer immediately adjacent the substrate; a bonding layer immediately adjacent the reaction layer, with the bonding layer comprising a first composition; and a low friction, lubricious layer immediately adjacent the bonding layer, with the lubricious layer comprising a second composition that is different from the first composition.

In another aspect of the present invention, a method of making a lubricant coating on a substrate comprises applying a bonding layer on the substrate, with the bonding layer comprising a first composition; heating the bonding layer in the substantial absence of curing the bonding layer; forming a reaction layer between the bonding layer and substrate; applying a lubricious layer on the bonding layer, with the lubricious layer comprising a second composition that is different from the first composition; and curing the bonding and lubricious layers.

These and other features, aspects and advantages of the present invention will become better understood with reference to the following drawings, description and claims.

DETAILED DESCRIPTION OF THE INVENTION

The present invention generally provides a low friction, low wear lubricant coating 10 on a substrate 11 such that the coating 10 is interposed between the substrate 11 and a counter surface 12 that is moving relative to the substrate 11. While the coating 10 may be particularly useful in the application of lubricating foils and fluid bearings in high speed rotating machinery, the present invention is not so limited. In general, the coating 10 may be used for any surfaces that require lubrication and, therefore, such surfaces can include pistons, cams, cylinder liner coatings, and oil free compressors as examples.

Figure 3:
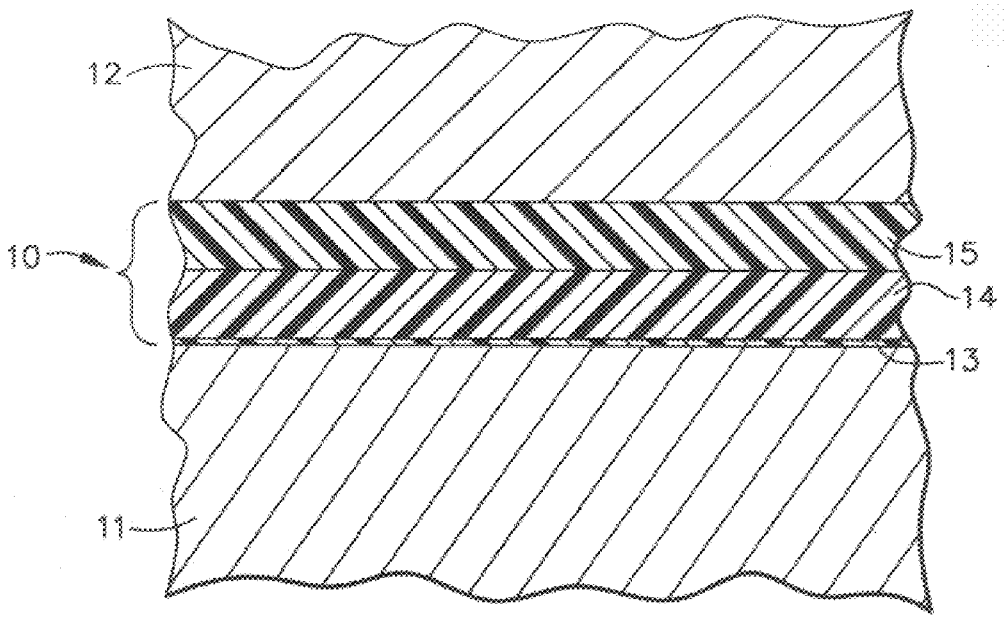
FIG. 3 is a schematic diagram (not to scale) of a lubricant coating according to the present invention.

FIG. 3 depicts one embodiment of a lubricant coating 10 in accordance with the present invention and that is bonded to a substrate 11 such that the coating can run against a counter surface 12. In general, the coating 10 includes a reaction layer 13 immediately adjacent the substrate 11 and a bonding layer 14 that is immediately on top of the reaction layer 13 when viewed from FIG. 3. A low friction, low wear lubricious layer 15 is immediately on top of the bonding layer 14 when viewed from FIG. 3.

In more particularly describing the present invention, the reaction layer 13 serves to chemically bond the bonding layer 14 to the substrate 11. In contrast, the prior art commonly appears to omit a similar reaction layer. In any event, the reaction layer 13 is formed of a composition that includes at least a portion of the materials in the substrate 11 and materials in the bonding layer 14. More specifically, the reaction layer 13 comprises chemical bonds formed between elements in the substrate 11 and the bonding layer 14.

The reaction layer 13 is characterized as being self-limiting in thickness. In other words, during the formation of the reaction layer 13, as further described below, the chemistry between the materials in the substrate 11 and the materials in the bonding layer 14 prevents the building of a large thickness in the reaction layer 13. This characteristic of self-limiting is in contrast to the prior art.

While the thickness of the reaction layer 13 can vary depending upon the specific context, it is usefully between about 0.01 to 0.1 mils. Preferably, the thickness is between about 0.01 to 0.03 mils. If the reaction layer 13 was not otherwise self-limited, below a thickness of about 0.01 mils, then coating fragmentation tends to occur. Above about 0.2 to 0.3 mils, the reaction layer 13 tends to be porous and, consequently, a compromise in bonding tends to occur.

The bonding layer 14 is comprised of a first or bonding composition that can create the reaction layer 13. This, too, is in contrast to the prior art which has usually not provided a separate bonding layer. Generally, the bonding composition is based upon the composition of the substrate 11 such that an appropriate reaction layer 13 can be formed. Therefore, the bonding composition includes one or more bonding agents that can form chemical bonds in the reaction layer 13 with elements from the substrate 11. In the particular embodiments described below, the bonding agents can include, for example, boron nitride, tungsten sulfide, graphite fluoride, molybdenum sulfide, and mixtures thereof. For blends or mixtures of bonding agents, the specific combinations are based on the formation of a self-limiting reaction layer. The relative amounts of one bonding agent to another is based on individual reactions. For example, graphite fluoride which forms an unconstrained, thick, reaction layer 13 can be made to form a self limiting reaction layer by addition of 10–20 volume % of tungsten sulfide or boron nitride solid lubricant. Also included in the bonding composition is at least one polymer matrix such as polyimide, novolac polycyanate esters, poly(arylene ethers) and bismaleimide resins.

The relative amounts of polymer matrix to bonding agent can vary, depending upon the particular bonding layer 14 to be formed. Nevertheless, the bonding agent is usefully present at about 30 to 50 vol %. Preferably, the bonding agent is present at about 40 to 45 vol %. Below about 30 vol %, disadvantages include poor bond layer 14 formation due to inadequate matrix phase, while above 50 vol %, disadvantages include poor lubricant properties. The thickness of the bonding layer 14 can likewise vary, depending upon the particular context of the coating 10. Preferably, however, the bonding layer 14 has a thickness between about 0.1 to 0.6 mils. Below a thickness of about 0.1 mils, poor reaction layer 13 formation tends to occur. Above about 0.6 mils, the bonding layer 14 tends to dominate the overall coating, limiting the thickness of the lubricating top layer 15.

In describing specific embodiments of the bonding layer 14, it can be noted that a polyimide resin containing a tungsten sulfide (WS2) solid lubricant has surprisingly different bonding properties with a ferrous alloy substrate 11 such as stainless steel when compared to polyimide resin containing a graphite fluoride solid lubricant. The tungsten sulfide reacts with water from the polyimide during curing (as described below) to produce hydrogen sulfide. In turn, the hydrogen sulfide reacts with iron base alloys in the substrate 11 to form the self-limiting reaction layer 13.

Figure 1:
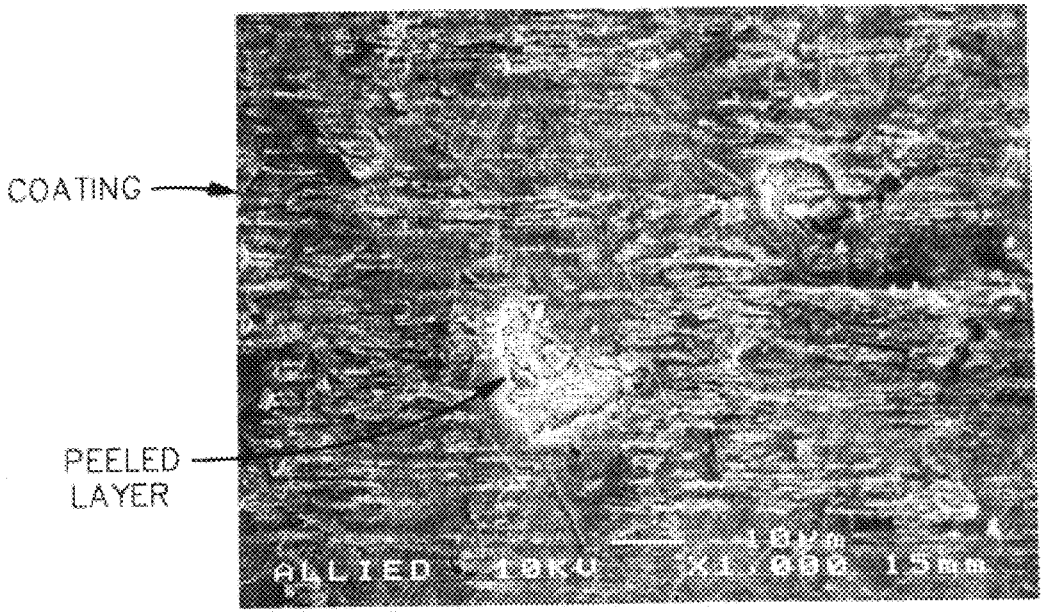
FIG. 1 (PRIOR ART)
FIG. 1 is an SEM micrograph (at 1000×) top view of a polyimidegraphite fluoride coating on stainless steel according to the prior art.
Figure 2:
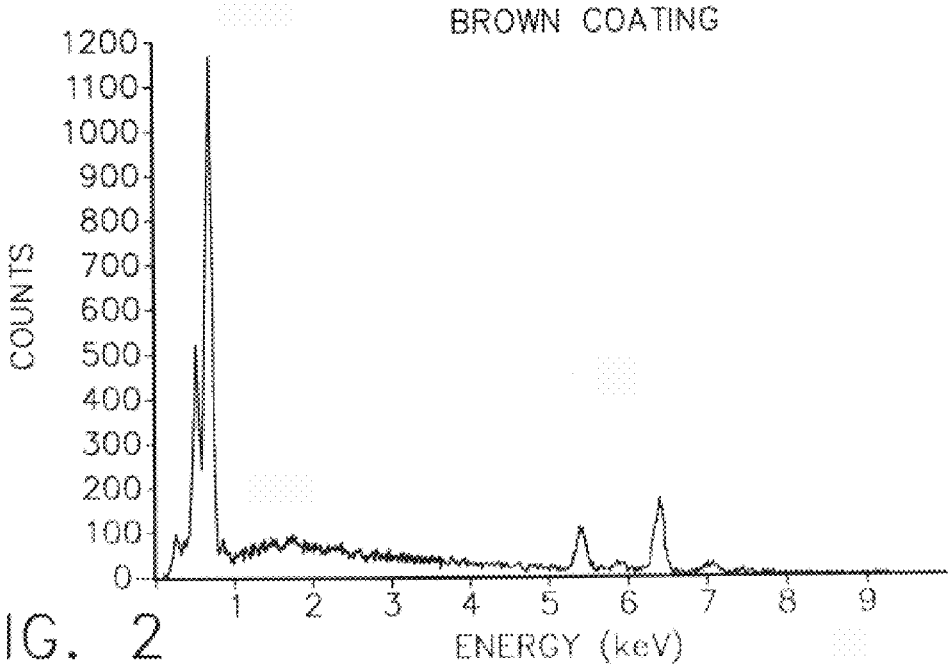
FIG. 2 (PRIOR ART)
FIG. 2 is a graph of EDAX analysis of the polyimidegraphite coating shown in FIG. 1.
Figure 4:
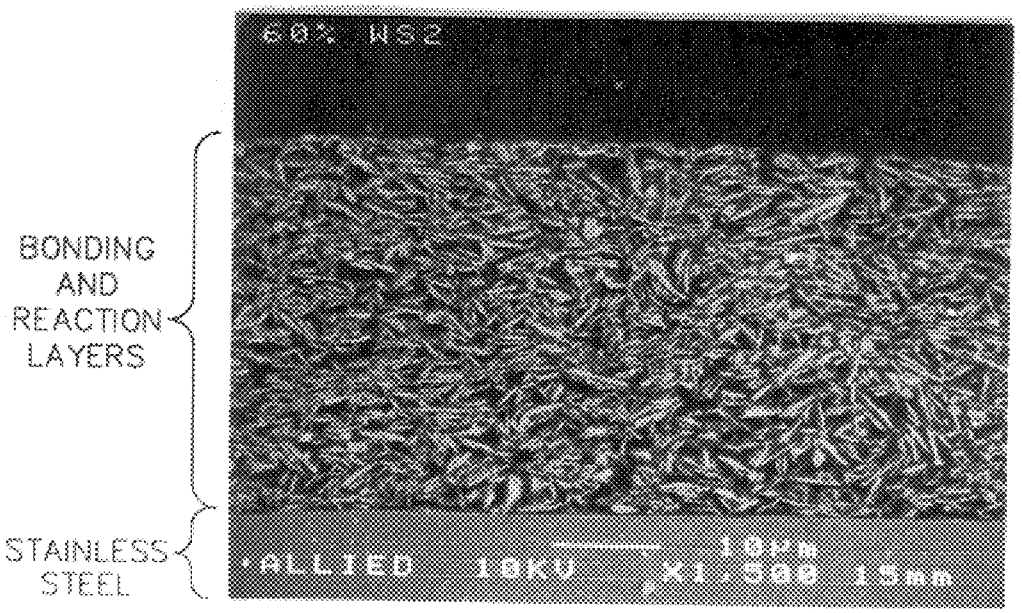
FIG. 4 is an SEM micrograph (at 1500×) cross sectional view of a polyimide lubricant coating containing a tungsten sulfide bond layer on a stainless steel substrate according to the present invention, wherein the tungsten sulfide bond layer produces a reaction layer forming a well bonded coating.
Figure 5:
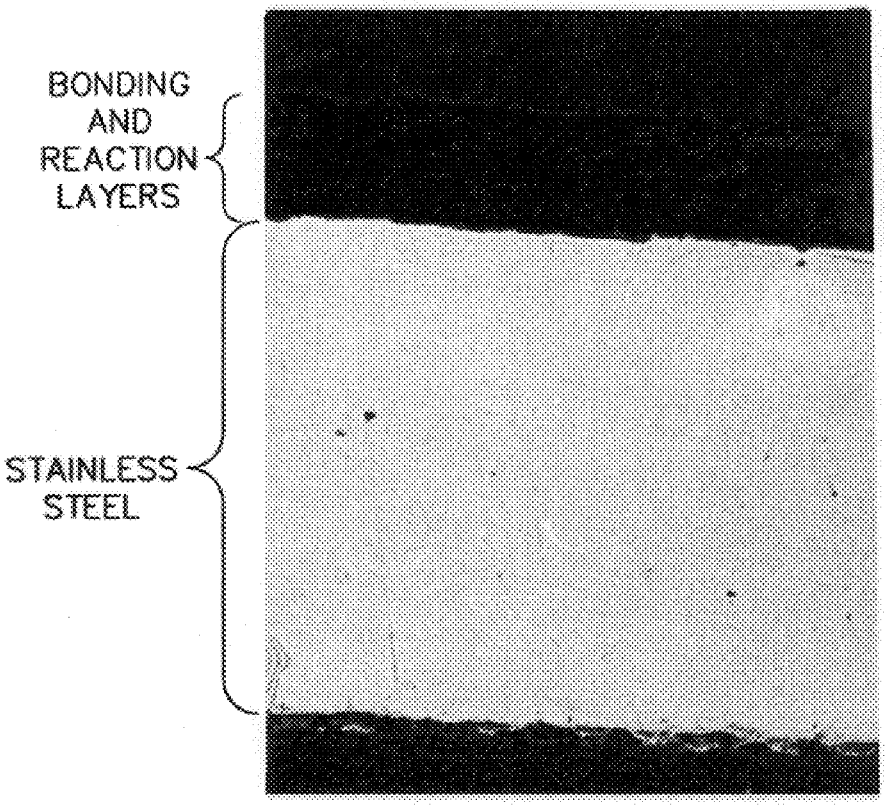
FIG. 5 is an optical micrograph (at 466×) cross sectional view of a polyimide lubricant coating containing boron nitride and a graphite fluoride bond layer on a stainless steel substrate according to the present invention wherein the boron nitride component in the boron nitride—graphite fluoride solid lubricant mixture produces a reaction layer forming a well bonded coating.

In FIG. 4, an SEM micrograph at 1500×of a polyimide resin containing a tungsten sulfide solid lubricant on a stainless steel substrate is shown as having a good bond, as evidenced by a well formed thin reaction layer and complete absence of delamination. In another embodiment, a polyimide resin containing a boron nitride (BN) solid lubricant forms a self-limiting reaction layer 13, thereby creating a good bond to stainless steel. In FIG. 5, an optical micrograph at 466×of a polyimide resin containing a blend of 12 volume % boron nitride and 88 volume % graphite fluoride shows good bonding to stainless steel, as evidenced by a well formed thin reaction layer and complete absence of delamination. In view of the poor bonding of stainless steel to a polyimide resin containing a graphite fluoride solid lubricant, as shown in FIG. 1, it is surprising that a good bond can be formed by blending tungsten sulfide or boron nitride into the graphite fluoride composition.

Another embodiment of the present invention includes a substrate 11 comprised of a nickel alloy, such as Inconel™ made by Inco Inc. In such instance, the bonding agent is graphite fluoride.

The low friction, lubricious layer 15 is comprised of a second or lubricious composition that is different from the bonding composition. This too is in contrast to the prior art, which has typically provided a layer that attempts to provide a combined lubricious and bonding composition and, thus, the dual functions of low friction and bonding. Generally, the lubricious composition is based upon the composition of the counter surface 12 against which the lubricious layer 15 is intended to run. Therefore, the lubricious composition includes one or more friction agents that provide the lubricious layer 15 with the characteristics of low friction and low wear. In the particular embodiments described below, the friction agent can include boron nitride, tungsten sulfide, graphite fluoride, and mixtures thereof. For blends or mixtures of friction agents, the specific combinations are based on low friction and low wear when run against the counter surface. The relative amounts of one friction agent to another is based on friction and wear properties. As with the bonding composition, the lubricious composition includes at least one polymer matrix, such as polyimide, novolac polycyanate esters, and bismaleimide resins.

The relative amounts of polymer matrix to friction agent can vary, depending upon the particular lubricious layer 15 to be formed. Nevertheless, the friction agent is usefully present at about 30 to 50 vol %. Preferably, the friction agent is present at about 40 to 50 vol %. Below about 30 vol.%, disadvantages include poor lubricity due to lack of lubricants, while above 50 vol.%, disadvantages include poor mechanical integrity of the lubrication due to reduced polymer matrix phase. The thickness of the lubricious layer 15 can likewise vary, depending upon the particular context of the coating 10. Preferably, however, if the bonding layer 14 has a thickness between about 0.1 to 0.6 mils, then the lubricious layer 15 has a thickness between about 0.8 to 1.3 mils. Below a thickness of about 0.6 mils, then poor wear properties due to too thin a lubricating layer tends to occur. Above about 1.5 mils, the lubricious layer 15 tends to have bubbles and segregated inhomogenieties.

For a specific embodiment of the present invention wherein graphite fluoride is a friction agent, the counter surface 12 comprises a surface material that includes, for example, chromium, chromium nitride, chromium carbide, titanium nitride, titanium aluminum nitride, and plasma sprayed oxides such as alumina. More particularly, a graphite fluoride solid lubricant loaded polyimide layer 15 runs well against a chromium counter surface 12. But surprisingly, the same layer 15 does not bond well on a stainless steel substrate 11 that has a chromium oxide layer similar to a chromium surface. The graphite fluoride solid lubricant loaded polyimide layer 15 also runs well against other counter surfaces 12 such as physical vapor deposited titanium nitride, titanium aluminum nitride, chromium nitride, and chromium carbide.

On the other hand, a tungsten sulfide or boron nitride containing polyimide layer 15 is expected to poorly perform against a chromium plated counter surface 12 due to the chemical bonding nature between such layer 15 and surface 12. Likewise, blends or mixtures of graphite fluoride, tungsten sulfide and boron nitride in a polyimide layer 15 is expected to have relatively poor friction and wear properties when run against a chromium counter surface 12 due to its chemical bonding nature.

A method of making the reaction layer 13, the bonding layer 14, and the lubricious layer 15 generally includes the acts or steps of applying the bonding layer 14 to the substrate 11. The bonding layer 14 is then heated but without curing the bonding layer 14 so that solvents in the layer 14 are eliminated. Applying the lubricious layer 15 to the bonding layer 14 and heating to remove solvents next occurs. Thereafter, the bonding layer 14 and the lubricious layer 15 are cured.

Applying the layers 14, 15 can be accomplished by various techniques such as painting, brushing, spraying, and film coating. Preferably, the layers 14, 15 are made by producing solid lubricant sheets according to coil coating methodologies, such as that described in E. Cohen and E. Gutoff, eds., Modem Coating and Drying Technology, Wiley-VCH Publishers, New York (1992) and incorporated herein by reference. Suitable coil coating methods include dip coating, rod coating, blade coating, gravure coating, reverse roll coating, and extrusion coating.

During the heating of the bonding layer 14, the formation of the reaction layer 13 is also initiated. As mentioned above, however, the formation of the reaction layer 13 is self-limiting in terms of thickness. No additional steps need be taken to limit the thickness of the reaction layer 13. Further, the heating does not cure the bonding layer 14. The absence of curing at this point in the process enables the bonding layer 14 to be integrated physically with the lubricious layer 15 during the subsequent curing step. This aspect of the present invention is contrary to the typical prior art methodology of curing each thin layer of a multilayer coating before the next thin layer is applied.

Accordingly, and if for example, a coating method is utilized, a substrate 11 that is coated with the bonding layer 14 is heated to remove the solvents. The coated sheet or substrate 11 is then re-run through the coating machine to produce the lubricious or top layer 15 and heated to remove solvents in the layer 15. Thereafter, both the bonding layer 14 and lubricious layer 15 are simultaneously cured. However, the heating of the lubricious layer 15 need not be a separate step from curing.

Figure 6:
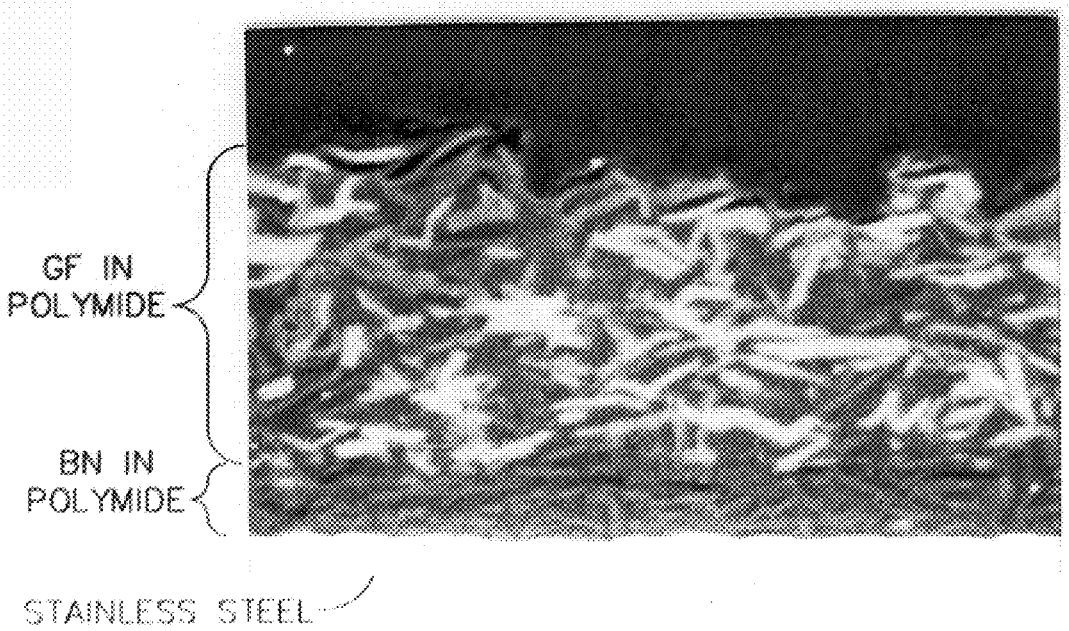
FIG. 6 is an SEM micrograph (at 2000×) cross sectional view of a lubricant coating containing polyimides of different compositions on a stainless steel substrate according to the present invention.

Thus, in a specific embodiment of the method of the present invention, a bonding layer 14 may comprise boron nitride and polyimide and be applied to a stainless steel substrate 11. The boron nitride/polyimide layer 14 is heated at about 300 to 500° F. for about 1 to 8 minutes to drive off solvents but not to cure the polyimide. A lubricious layer 15 of graphite fluoride/ polyimide is then applied over the boron nitride/ polyimide layer 14, heated to remove the solvents, and cured at a final temperature of about 600–750° F. for about 15 to 70 minutes using convection heating. Cure times may be lower using IR heating. The resulting coating 10 is shown in FIG. 6 which is an SEM micrograph at 2000×.

One preferred method of determining the bond strength of the coating 10 is to apply the coating 10 on a thin sheet of material and then bend the sheet over a sharp radius. The sharp bending will delaminate and crack the coating if the adhesion is weak. Another method of quantifying the bond strength is to conduct a pull test on the coating 10 by bonding a nail to the coating 10 and pulling it in a testing machine to separate the coating 10. Yet another method of qualifying the coating 10 is to conduct a Tabor wear test wherein the coating 10 is abraded in a controlled manner. Coatings which are poorly bonded will essentially wear away.

EXAMPLES

The bending test described above was used to test various single bonding layers 14 on various substrate sheets 11. The last test run used two layers 14. The sheets 11 were 6 mils thick, the layers 14 were 1 mil thick, and the bend pin radius was 3/32 inches. The results are shown in Table 1 below. A "Pass" results means that no delamination or cracks were seen, while a "Fail" results means that cracks were seen and delamination of the coating was observed.

TABLE 1

Bend test of polyimide-solid lubricant coatings on sheets

| Material | Result |
|---|---|
| (A) polyimide-graphite fluoride (GF) on Inconel™ | Pass |
| (B) polyimide-GF on 301 stainless steel | Fail |
| (C) polyimide-boron nitride (BN) on stainless steel | Pass |
| (D) polyimide-tungsten sulfide (WS2) on stainless steel | Pass |
| (E) blend of polyimide-BN/GF on stainless steel | Pass |
| (F) blend of polyimide-WS2/GF on stainless steel | Pass |
| (G) 2 layers - polyimide-BN & polyimide-GF on stainless steel | Pass |

The following describes the final cure coating compositions for the above:

(A): 30 vol. % GF in polyimide (B): 30 vol. % GF in polyimide (C): 40 vol. % BN in polyimide (D): 40 vol. % WS2 in polyimide (E): 10 vol. % BN, 30 vol. % GF in polyimide (F): 10 vol. % WS2,30 vol. % GF in polyimide (G): layer 1: 40 vol. % BN in polyimide layer 2: 30 vol. % GF in polyimide The test results show that polyimide resin loaded with graphite fluoride bonds well to nickel superalloys (i.e., Inconel™), but does not bond to ferrous alloys such as stainless steel. Polyimide resin loaded with tungsten sulfide or boron nitride bonds well to stainless steel and passes the bend test. Blends of boron nitride or tungsten sulfide mixed with graphite fluoride allow the polyimide resin coating to bond to stainless steel and pass the bend test.

The pull test described above was used to test various single bonding layers 14 on various substrate sheets 11 with the some of the compositions from above. The last test run used two layers 14. The thickness of the layers 14 and sheets 11 were the same as in the above tests. The pull test results are shown in Table 2 below.

TABLE 2

Pull strength of coatings

| Material | Load at break kN |
|---|---|
| (A) polyimide-graphite fluoride (GF) on Inconel™ | >0.16 |
| (B) polyimide-GF on stainless steel | 0 |
| (C) polyimide-boron nitride (BN) on stainless steel | 0.22 |
| (E) blend of polyimide-BN/GF on stainless steel | 0.12 |
| (F) blend of polyimide-WS2/GF on stainless steel | 0.12 |
| (G) 2 layers - polyimide-BN & polyimide-GF on stainless steel | 0.12–0.25 |

The results indicate that-pull strengths over_0.1 kN has adequate bond strength.

The Tabor test described above was used to test various single bonding layers 14 on various substrate sheets 11 with some of the compositions from above. The last test run used two layers 14. The thickness of the layers 14 and sheets 11 were the same as in the above tests. The Tabor test results are shown in Table 3 below.

TABLE 3

Tabor Abrasion Test

| Material | mg loss/250 rev |
|---|---|
| (A) polyimide-graphite fluoride (GF) on Inconel™ | 17 |
| (B) polyimide-GF on stainless steel | 0 - Adhesion Fail |
| (E) blend of polyimide-BN/GF on stainless steel | 77 |
| (G) 2 layers - polyimide-BN & polyimide-GF on stainless steel | 18 |

The results indicate that well bonded coatings with adequate pull strength and dispersion of solid lubricant in the matrix phase and cure show good wear properties. The high wear of blend of polyimide-BN/GF is due to the presence of BN on the surface-creating bond with a chromium plated counter-surface.

As can be appreciated by those skilled in the art, the present invention provides an improved lubricant coating for fluid bearings, as an example. Also provided is an improved method of making a lubricant coating. A lubricant coating and method of making the same is provided with improved bonding to a substrate. A lubricant coating and method of making the same is provided with better friction and wear properties at the same as better bonding. The present invention obviates the need for multiple thin layers and alternating curing steps, which otherwise leads to increased manufacturing time and costs. Further provided is a lubricant coating that provides chemical reactivity with the substrate on which the coating is applied to produce good bond quality between the coating and substrate.

It should be understood, of course, that the foregoing relates to preferred embodiments of the invention and that modifications may be made without departing from the spirit and scope of the invention as set forth in the following claims.

We claim:

1. A lubricant coating on a substrate, comprising:

a reaction layer immediately adjacent said substrate;

a bonding layer adjacent said reaction layer, said bonding layer comprising a first composition; and a lubricious layer immediately adjacent said bonding layer, said lubricious layer comprising a second composition that is different from said first composition.

2. The coating of claim 1, wherein said first and second compositions comprise a polymer.

3. The coating of claim 1, wherein said first composition comprises a bonding agent selected from the group consisting of boron nitride, tungsten sulfide, graphite fluoride, molybdenum sulfide, and mixtures thereof.

4. The coating of claim 1, wherein said second composition comprises a friction agent selected from the group consisting of boron nitride, tungsten sulfide, graphite fluoride, and mixtures thereof.

5. A lubricant coating disposed between a substrate and a counter surface, comprising:

a reaction layer immediately adjacent said substrate;

a bonding layer immediately adjacent said reaction layer, said bonding layer comprising a first composition; and a lubricious layer immediately adjacent said bonding layer, said lubricious layer comprising a second composition that is different from said first composition.

6. The coating of claim 5, wherein said first and second compositions comprise a polymer selected from the group consisting of polyimide, novolac polycyanate esters, poly (arylene ethers), and bismaleimide resins.

7. The coating of claim 5, wherein said substrate comprises a nickel alloy and said first composition includes a bonding agent comprising graphite fluoride.

8. The coating of claim 5, wherein said substrate comprises a ferrous alloy and said first composition includes a bonding agent selected from the group consisting of boron nitride, tungsten sulfide, and mixtures thereof.

9. The coating of claim 8, wherein said ferrous alloy comprises stainless steel.

10. The coating of claim 5, wherein said reaction layer comprises a third composition that is a combination of portions of said first composition and a composition of said substrate.

11. The coating of claim 10, wherein said reaction layer is formed from a reaction between said bonding layer and substrate.

12. The coating of claim 5, wherein said counter surface comprises a surface material selected from the group consisting of chromium, chromium nitride, chromium carbide, titanium nitride, titanium aluminum nitride, and plasma sprayed oxides; and said second composition includes a friction agent comprising graphite fluoride.

13. A lubricant coating on a substrate, comprising:

a bonding layer adjacent said substrate, said bonding layer comprising a first composition;

a lubricious layer adjacent a side of said bonding layer that is opposite said substrate, the lubricious layer comprising a second composition, wherein there exists at least one component of the first composition and the second composition that is not common to both the first composition and the second composition; and a reaction layer between said bonding layer and said substrate.

14. The coating of claim 13, wherein the thickness of the reaction layer is self-limiting to about 0.01 to 0.1 mils.

15. The coating of claim 13, wherein the thickness of the bonding layer is between about 0.1 to 0.6 mils.

16. The coating of claim 13 , wherein said first and second compositions each comprise a polymer.

17. The coating of claim 13, wherein said first composition comprises a bonding agent selected from the group consisting of boron nitride, tungsten sulfide, graphite fluoride, molybdenum sulfide, and mixtures thereof.

18. The coating of claim 13, wherein said second composition comprises a friction agent selected from the group consisting of boron nitride, tungsten sulfide, graphite fluoride, and mixtures thereof.

19. The coating of claim 16, wherein the polymer is selected from the group consisting of polyimide, novolac polycyanate esters, poly(arlyene ethers) and bismaleimide resins.

20. A lubricant coating disposed between a substrate and a counter surface, comprising:

a reaction layer immediately adjacent said substrate;

a polymer bonding layer immediately adjacent said reaction layer, said bonding layer comprising a first composition;

a polymer lubricious layer immediately adjacent said bonding layer, said lubricious layer comprising a second composition that is different from said first composition;

said first composition comprising a bonding agent selected from the group consisting of boron nitride, tungsten sulfide, graphite fluoride, molybdenum sulfide, and mixtures thereof; and wherein the bonding agent is present at about 30 to 50 volume per cent.

21. The coating of claim 20, wherein said polymer is selected from the group consisting of polyimide, novolac polycyanate esters, poly(arylene ethers), and bismaleimide resins.

22. The coating of claim 20, wherein said second composition comprises a friction agent selected from the group consisting of boron nitride, tungsten sulfide, graphite fluoride, and mixtures thereof.

23. The coating of claim 22, wherein said friction agent is present at about 30 to 50 volume per cent.

24. The coating of claim 20, wherein said substrate comprises a nickel alloy.

25. The coating of claim 20, wherein said substrate comprises a ferrous alloy.

26. The coating of claim 20 wherein said reaction layer comprises a third composition that is a combination of portions of said first composition and a composition of said substrate.

27. The coating of claim 20, wherein the thickness of said reaction layer is self-limiting to about 0.01 to 0.1 mils.

28. The coating of claim 20, wherein the thickness of said bonding layer is between about 0.1 to 0.6 mils.

29. A lubricant coating disposed between a substrate and a counter surface, comprising:

a reaction layer immediately adjacent said substrate;

a polymer bonding layer immediately adjacent said reaction layer, said bonding layer comprising a first composition;

a polymer lubricious layer immediately adjacent said bonding layer, said lubricious layer comprising a second composition that is different from said first composition;

said second composition comprising a friction agent selected from the group consisting of boron nitride, tungsten sulfide, graphite fluoride, and mixtures thereof; and wherein the friction agent is present at about 30 to 50 volume per cent.

30. The coating of claim 29, wherein said polymer is selected from the group consisting of polyimide, novolac polycyanate esters, poly(arylene ethers), and bismaleimide resins.

31. The coating of claim 29, wherein said first composition comprises a bonding agent selected from the group consisting of boron nitride, tungsten sulfide, graphite fluoride, molybdenum sulfide, and mixtures thereof.

32. The coating of claim 29, wherein said bonding agent is present at about 30 to 50 volume per cent.

33. The coating of claim 29 wherein said substrate comprises a nickel alloy.

34. The coating of claim 29, wherein said substrate comprises a ferrous alloy.

35. The coating of claim 29, wherein said reaction layer comprises a third composition that is a combination of portions of said first composition and a composition of said substrate.

36. The coating of claim 29, wherein the thickness of said reaction layer is self-limiting to about 0.01 to 0.1 mils..

37. The coating of claim 29, wherein the thickness of said bonding layer is between about 0.1 to 0.6 mils.

* * * * *